United States Patent [19]

Greene

[11] Patent Number: 4,834,060

[45] Date of Patent: May 30, 1989

[54] HAND CARRIED BATTERY POWERED BALL THROWING APPARATUS

[75] Inventor: William J. Greene, Los Angeles, Calif.

[73] Assignee: Tennis Tutor, Inc., Glendale, Calif.

[21] Appl. No.: 29,778

[22] Filed: Mar. 25, 1987

[51] Int. Cl.[4] ..... F41B 3/04

[52] U.S. Cl. ..... 124/78; 273/26 D; 318/139; 318/810

[58] Field of Search ..... 124/1, 6, 78, 47, 49, 124/41, 45; 273/26 D; 220/4 A, 6; 318/810, 811, 139, 558; 363/124; 320/2; 298/24; 248/621, 638

[56] References Cited

U.S. PATENT DOCUMENTS

| | | | |
|---|---|---|---|
| Re. 24,493 | 6/1958 | Phillips | 220/6 |
| Re. 28,462 | 7/1975 | Halstead | 124/78 |
| 252,389 | 1/1882 | Livingstone | 220/6 X |
| 1,204,468 | 1/1916 | Marty | 124/6 |
| 2,678,797 | 5/1954 | Roy | 248/621 X |
| 3,052,435 | 9/1962 | Roller | 248/621 X |
| 3,198,324 | 8/1965 | Kallenbach et al. | 248/621 X |
| 3,223,909 | 12/1965 | Sensing et al. | 318/139 |
| 3,243,681 | 3/1966 | Dannettell | 318/139 X |
| 3,349,309 | 10/1967 | Dannettell | 318/139 X |
| 3,568,653 | 3/1971 | Earle | 124/1 |
| 3,570,466 | 3/1971 | White et al. | 124/54 |
| 3,604,409 | 9/1971 | Doeg | 124/78 |
| 3,716,767 | 2/1973 | Kuriyama et al. | 318/139 |
| 3,753,059 | 8/1973 | Berman | 318/139 |
| 3,774,584 | 11/1973 | Paulson | 124/78 |
| 3,777,732 | 12/1973 | Holloway et al. | 124/78 |
| 3,785,358 | 1/1974 | D'Angelo | 124/78 |
| 3,901,552 | 8/1975 | Stone | 298/24 |
| 3,913,552 | 10/1975 | Yarur et al. | 124/78 |
| 4,086,903 | 5/1978 | Scott | 124/78 |
| 4,092,580 | 5/1978 | Prinsze | 320/2 |
| 4,140,097 | 2/1979 | Lewis | 124/80 |
| 4,206,502 | 6/1980 | Harries et al. | 318/811 X |
| 4,398,139 | 8/1983 | Prinsze | 320/2 |
| 4,583,514 | 4/1986 | Nozato | 124/78 |
| 4,678,095 | 7/1987 | Barnett et al. | 220/4 F |
| 4,692,680 | 9/1987 | Sherer | 320/2 |
| 4,705,257 | 11/1987 | Leo et al. | 248/638 X |

FOREIGN PATENT DOCUMENTS

| | | | |
|---|---|---|---|
| 2459668 | 2/1981 | France | 124/78 |

*Primary Examiner*—Dennis L. Taylor
*Assistant Examiner*—John Ricci
*Attorney, Agent, or Firm*—Frank L. Zugelter

[57] ABSTRACT

Disclosed is an unusually light-weight, compact, self-contained, self-powered ball thrower adapted to be carried and transported in the trunk of a passenger vehicle. All rotary components are driven by miniature DC motors having permanent magnet stators to maximize lightness without sacrificing performance. The low power requirements of these motors is readily provided by an onboard AC to DC power converter or by a rechargeable storage battery. The housing is power-oscillated to vary lateral ball trajectory and the throwing wheels are tiltable to vary the vertical delivery trajectory. An ample capacity ball hopper collapses compactly when not in use and a special control circuit assures uniform ball velocity during closely spaced successive ball throwing cycles.

21 Claims, 6 Drawing Sheets

HAND CARRIED BATTERY POWERED BALL THROWING APPARATUS

TECHNICAL FIELD

This invention relates to a ball throwing apparatus and more particularly to a unique compact hand portable ball thrower powered by an onboard AC to DC power converter or by a storage battery.

BACKGROUND ART

The widespread interest in ball sports, particularly baseball and tennis, has stimulated numerous proposals for power-driven ball throwing equipment enabling athletes to develop playing skill without need for opponents. Prior proposals to meet this need are subject to many disadvantages and shortcomings including complexity, excessive weight, high cost, unsuitability for transport except by truck, requiring handling by two or more persons and an available source of power. A major source of the size and weight of prior machines is the motor components having the requisite speed and torque characteristics to throw balls as often as once each second while maintaining a constant ball throwing velocity. Prior machines have achieved constant ball throwing velocity by using such large and powerful motors that their speed drops negligibly and recovers almost instantaneously while throwing a ball. The power requirements for motors meeting these needs have been grossly in excess of that available by storage batteries of a reasonable size for on-board portable use. No such equipment or machine to date has been perfected or is available which overcomes these disadvantages and shortcomings.

DISCLOSURE OF THE INVENTION

This invention provides a highly versatile ball thrower avoiding the foregoing and other shortcomings and disadvantages of prior constructions. The new and improved ball thrower is not only self-contained with an on-board power sorce, but it is unusually compact, light in weight, readily hand portable and regularly accommodated in the trunk or cabin of a motor vehicle. Both the ball feeding mechanism and the ball throwing wheels are powered by miniature DC motors with permanent magnet stators. The two ball throwing motors are equipped with a solid state power control circuit operable to switch power on and off many times per second in pulses of variable duration to provide wide-range speed control and more particularly to expedite speed recovery immediately following a ball throwing cycle. To this end utilization is made of an oscillator activated by a voltage clamped substantially below a nominal battery voltage to provide a stable output signal until the battery charge is substantially consumed. The output oscillator signal is utilized to turn the power to the ball throwing motors on and off many times per second for variable time intervals in relation to the sensed back EMF of these motors as their speed decays when a ball is thrown and recovers in an interval of approximately three seconds or less. A three second interval was selected as the minimum time between successive ball throwing operations, based upon the reaction and recovery time of an individual player to a ball throwing operation. The ball throwing motors were selected to be the minimum size and power rating possible to throw successive balls at three second intervals at the desired speed with the motors controlled by a solid state motor controller. The lower power and torque characteristics of these smaller motors causes them to slow down just enough during a ball throwing operation, so that the solid state power control circuitry can recover the lost speed within the three second interval before the next ball throwing operation, so that successive ball throwing operations are at a consistent speed. Motor speed is regulated by varying the time interval during which power is switched on to the motors. The control circuitry includes a jack for connecting the on-board battery to a source of charging power and includes visual means indicating the charge or condition of the battery while charging.

Mechanical features include a housing having a collapsible ball hopper opening into a ball indexing mechanism delivering individual balls to the counter rotating throwing wheels irrespective of their tilted position. These wheels and driving motors are pivotally supported to eject balls in a wide range of vertical trajectories. The apparatus housing is pivotally supported for power-driven oscillatory movement to provide wide range horizontal ball trajectories.

Although the self-contained ball thrower, including a battery or a power converter, typically weighs only 35 pounds, it is preferably equipped along one bottom edge with a set of rollers and with a collapsible towing handle to facilitate towing of the device over level surfaces.

Accordingly, it is a primary object of this invention to provide a unique self-contained hand portable ball thrower with an on-board power supply.

Another object of the invention is to provide an inexpensive light-weight portable ball thrower having improved means for automatically ejecting balls in wide range horizontal and vertical trajectories.

Another object of the invention is the provision of a compact light-weight ball thrower readily carried in the hand and accomodated in the trunk of a motor vehicle.

Another object of the invention is the provision of a self-contained ball thrower having an attached collapsible ball hopper opening into a motor powered ball feeder.

Another object of the invention is the provision of a self-contained ball thrower operable by either an on-board storage battery or by an AC to DC power converter connected to the miniature ball throwing motors by a control circuit having unique means for expediting motor speed recovery immediately following a ball throwing operation.

Another object of the invention is the provision of a ball thrower in which the counter-rotating ball throwing devices are pivotally supported and manually adjustable about an axis positioned forwardly of a generally upright plane containing the axes of the ball throwing wheels and motors.

Another object of the invention is the provision of a ball thrower which, in addition to being hand portable, is equipped with carriage wheels and a collapsible towing handle.

Another object of the invention is the provision of a ball thrower with a time delay that allows the ball throwing wheels to reach normal operating speed before the ball feeder is activated, and which allows a player to reach his playing position before ejection of the first ball thus eliminating wasted ball throws and replacing the functionality of a remote control to begin the ball feeding cycle.

BEST MODE FOR CARRYING OUT THE INVENTION

Figure 6:
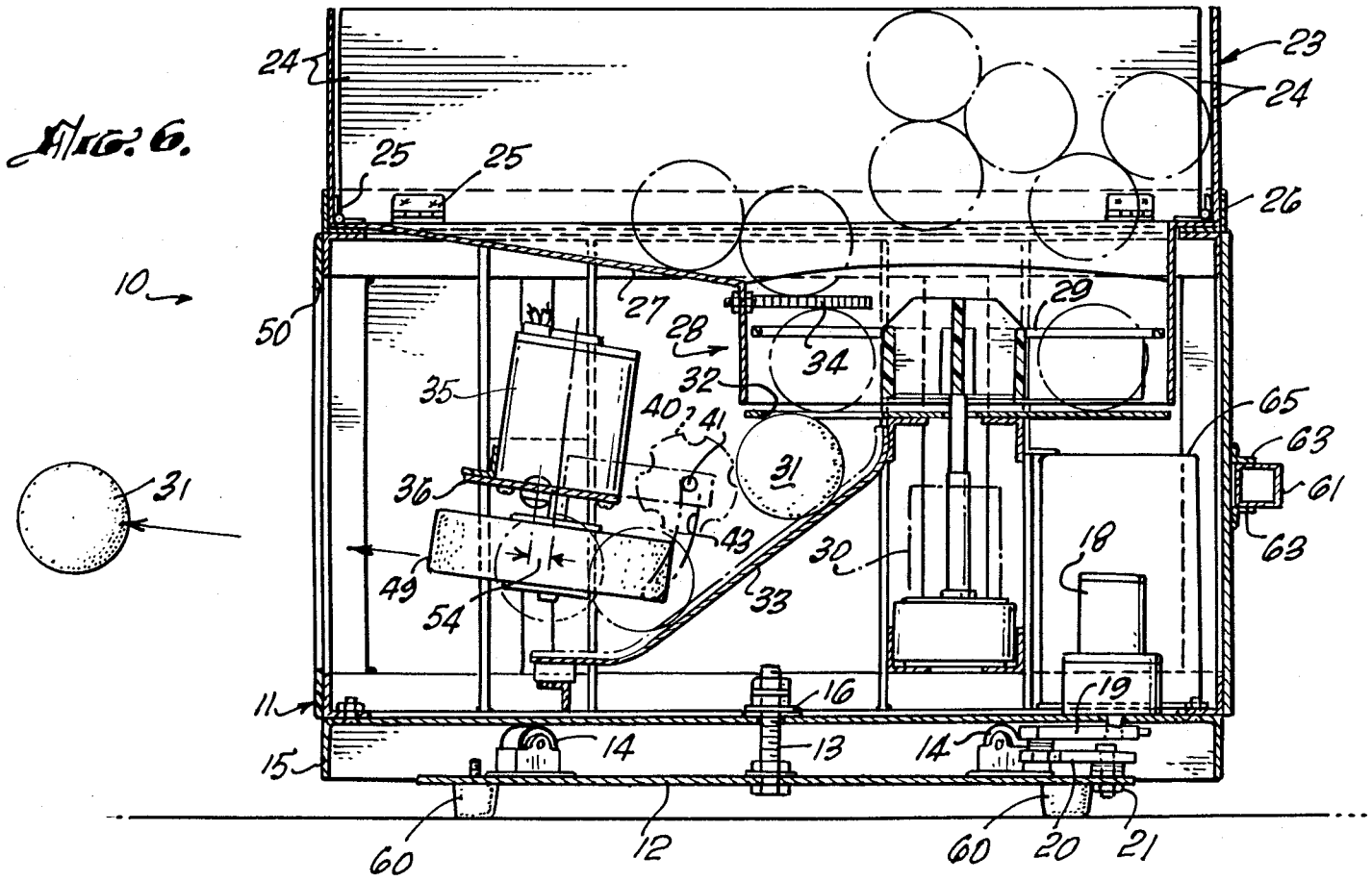
FIG. 6 is a cross sectional view taken along line 6—6 on FIG. 2.

Referring to FIGS. 1 to 7, there is shown an illustrative embodiment of the invention light-weight ball thrower designated generally 10. The apparatus has a main housing 11 formed of light-weight material such as aluminum. As is best shown in FIG. 6, this housing is pivotally supported on the supporting base 12 for horizontal oscillation about the vertical connecting bolt 13 on a plurality of rollers 14 supported on the upper side of base 12 inwardly of the housing skirt 15. Bolt 13 is secured to base 12 and extends through the bottom of housing 11 and thrust bearing 16.

Housing 11 and its contents are oscillated through a horizontal arc by a small DC gear motor 18 driving a crank arm 19 operatively connected to the outer end of a lever 20 pivotally connected to base 12 by a bolt 21. Crank 19 and lever 20 are so proportioned that the rotation of crank 19 operates to pivot housing 11 through a desired horizontal arc to vary the horizontal trajectory of the ball thrown by apparatus.

The balls to be thrown by the apparatus are contained in a hopper 23 overlying the top of housing 11 and formed of four panels 24 equipped with hinges 25 along their lower edges permitting these panels to be folded compactly against one another when not in use. A low height flange 26 embracing the lower edges of the panels limits outward expansion of the hopper walls.

The hopper bottom 27 slopes into the entrance of a ball indexing ball feeder 28 having an armed ball feeding rotor 29 mounted on the upper end of the shaft of a DC gearmotor 30. Each arm of the rotor accommodates a single ball 31 which exits through the sole outlet opening 32 of the indexing feeder or plate onto the upper end of a nonadjustable inclined stationary ball chute 33 for delivery by gravity into the ball throwing mechanism now to be described. Chute 33 is fixed at its upper end to suitable framework in housing 11. A close wound guard spring 34 (FIGS. 1 and 6) overlies outlet 32 and safeguards against more than one ball entering the outlet at one time.

Figure 1:
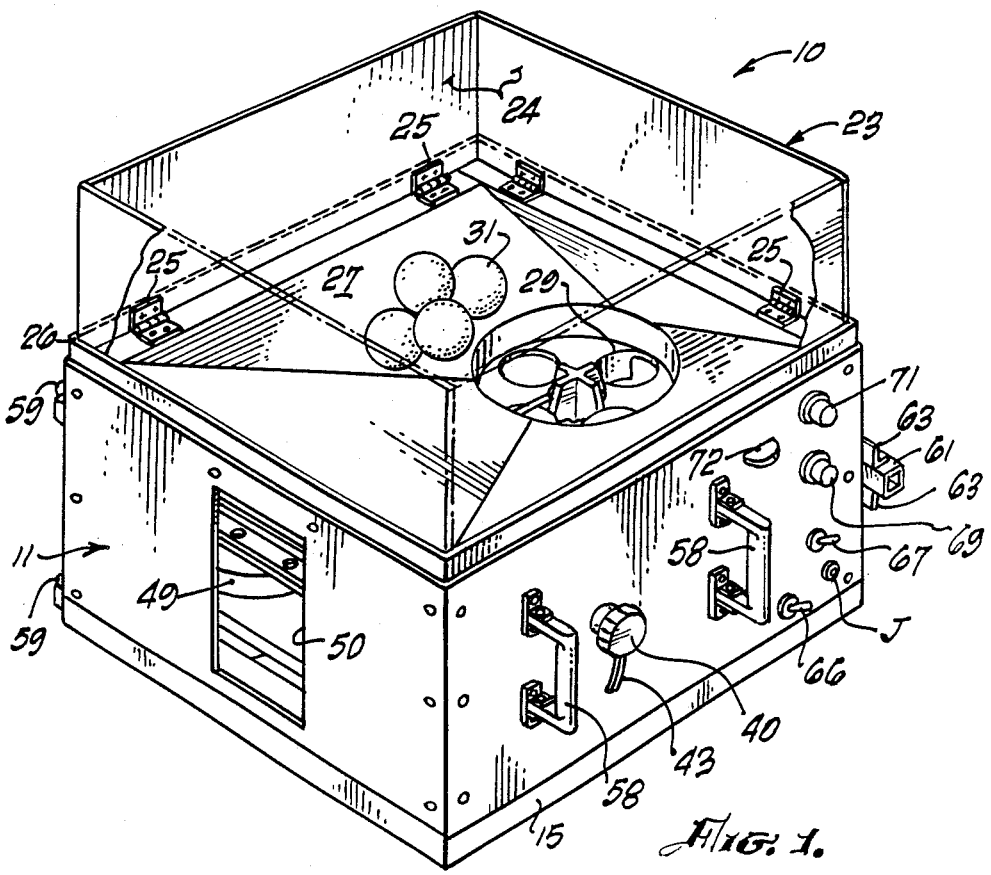
FIG. 1 is a perspective view of an illustrative embodiment of my improved hand-portable self-powered ball thrower with its collapsible ball hopper in open position.
Figure 3:
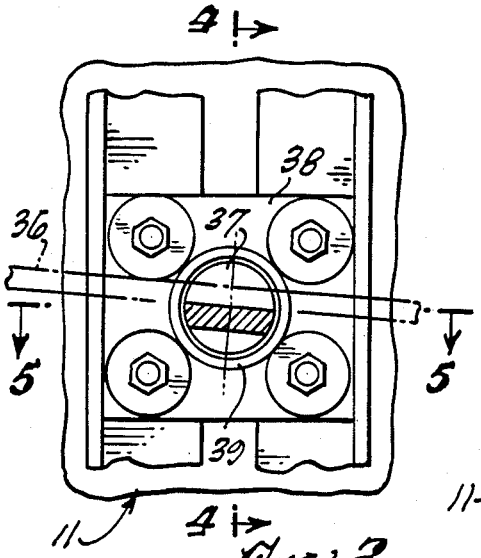
FIG. 3 is a view taken along line 3—3 on FIG. 2.
Figure 4:
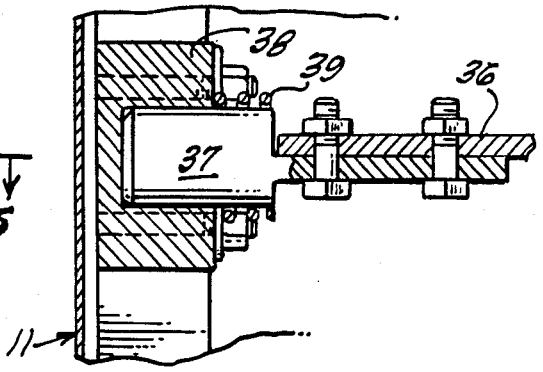
FIG. 4 is a view taken along line 4—4 on FIG. 3.
Figure 2:
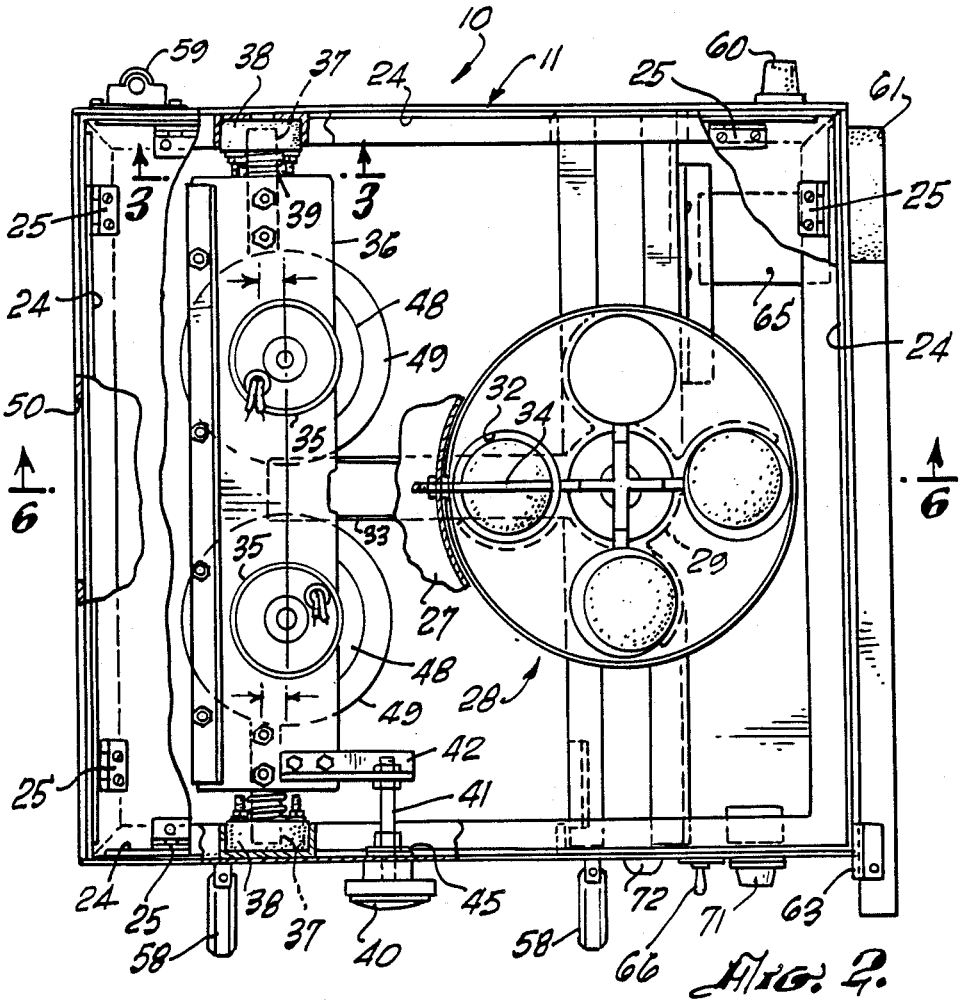
FIG. 2 is a top plan view of FIG. 1 with portions of the housing broken away to show internal components.
Figure 5:
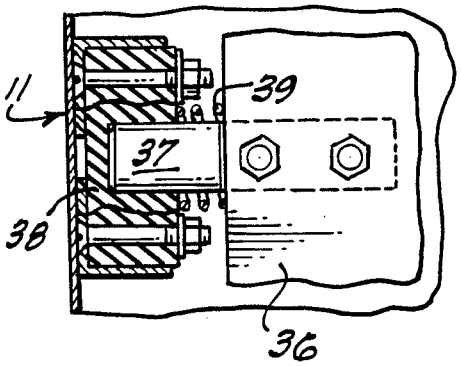
FIG. 5 is a view taken along line 5—5 on FIG. 3.

The ball throwing mechanism is best shown in FIGS. 2 and 6. This mechanism comprises a pair of counter-rotating motors 35 supported in an upright position on a shelf 36 pivotally and adjustably supported at its ends by trunnions 37 socketed in sound-absorbing elastomeric rings 38. Compression springs 39 surrounding trunnions 37 serve to compress the sound deadening material and prevent vibration and frictionally resist pivotal movement of the shelf. Adjustment of the shelf is accomplished by a manual clamping knob 40 rotatively supported on the outer end of a bolt 41 carried by an arm 42 projecting laterally from shelf 36. Bolt 41 extends through an arcuate slot 43 (FIG. 1) in the sidewall of housing 11 and is provided with washers 45 resting against the inner sidewall of the housing. These serve to clutch the shelf in a desired tilted position when knob 40 is tightened against the housing.

The shafts of motors 35 project through shelf 36. Rigidly anchored to the shafts of the counter rotating motors 35 are the ball throwing wheels 48 each equipped with cylindrical elastomeric tires 49. FIG. 2 best shows the wheels' peripheries being spaced apart in an area overlying the lower end of the ball delivery chute 33, the spacing being the best suited for gripping a ball grasped from a point on a length of inclined chute 33 and thrusting it outwardly through the delivery port 50 in the front wall of housing 11.

An important feature of the ball throwing wheels is the fact that their axes lie in a generally upright plane offset rearwardly of the axis of the shelf supporting trunnions 37 as is indicated at 54. This offset (FIG. 6), typically about ½ inch, enables the supporting shelf 36 to be pivoted throughout a wide range without impairing the ability of the wheels to grasp and throw a ball delivered from any point along a length of the rigidly and immovably supported delivery chute 33. Thus the vertical trajectory of the balls can be changed throughout its full range without need for making any adjustment in the position of chute 33 and without sacrificing the effectiveness of the throwing wheels.

The complete apparatus, including either an on-board 12-volt storage battery or an AC to DC power converter weighs approximately 35 pounds and has a sidewall length of not in excess of 18 inches. Accordingly, it is readily carried by hand using collapsible carrying handles 58 and is readily insertable into the trunk of an ordinary motor vehicle, or even the passenger compartment.

To further facilitate handling, one lateral edge of the housing is preferably equipped with a set of rollers 59 (FIG. 7) and a cooperating set of equal-height rubber feet 60 mounted to base 12. A collapsible towing handle 61 is pivotally connected by a bracket 63 to the housing diagonally opposite rollers 59. A portion of the towing handle extends beyond the pivot connection to bracket 63 and bears against the adjacent outer surface of the housing when the towing handle is pivoted to its towing position illustrated in FIG. 7. This permits the apparatus to be readily towed over a smooth surface after which handle 61 is pivoted back to its collapsed storage position.

THE ELECTRICAL SCHEMATIC AND MOTOR CONTROL ELECTRONICS

Before proceeding to describe the improved control circuitry for the present invention it is advantageous to comment briefly about the state of the prior art ball throwers and typical operating characteristics thereof contrasted with those of this invention. Typical prior art ball throwing machines have power requirements very substantially in excess of that feasible with storage batteries. These machines are of two general types, one being the counter-rotating wheel type utilizing approximately 300 watts and the other being a compressed air type to throw balls and typically consuming approximately 1000 watts of power. In striking contrast, the invention apparatus utilizes 15 to 60 watts readily and economically provided by a sealed on-board re-chargeable 12-volt storage battery weighing approximately 6 pounds which provides for approximately 2 to 3 hours of normal use.

The machine of this invention is oscillated in a horizontal orientation by a gear motor 18 and the balls are fed to chute 33 by gear motor 30 which indexes the feeder mechanism, each motor 18, 30 consuming about 3 watts. The ball throwing motors 35 have permanent magnet stators, are rated at ⅛ horsepower each, and together consume power between 10 and 55 watts depending upon the ball throwing velocity.

Figure 10:
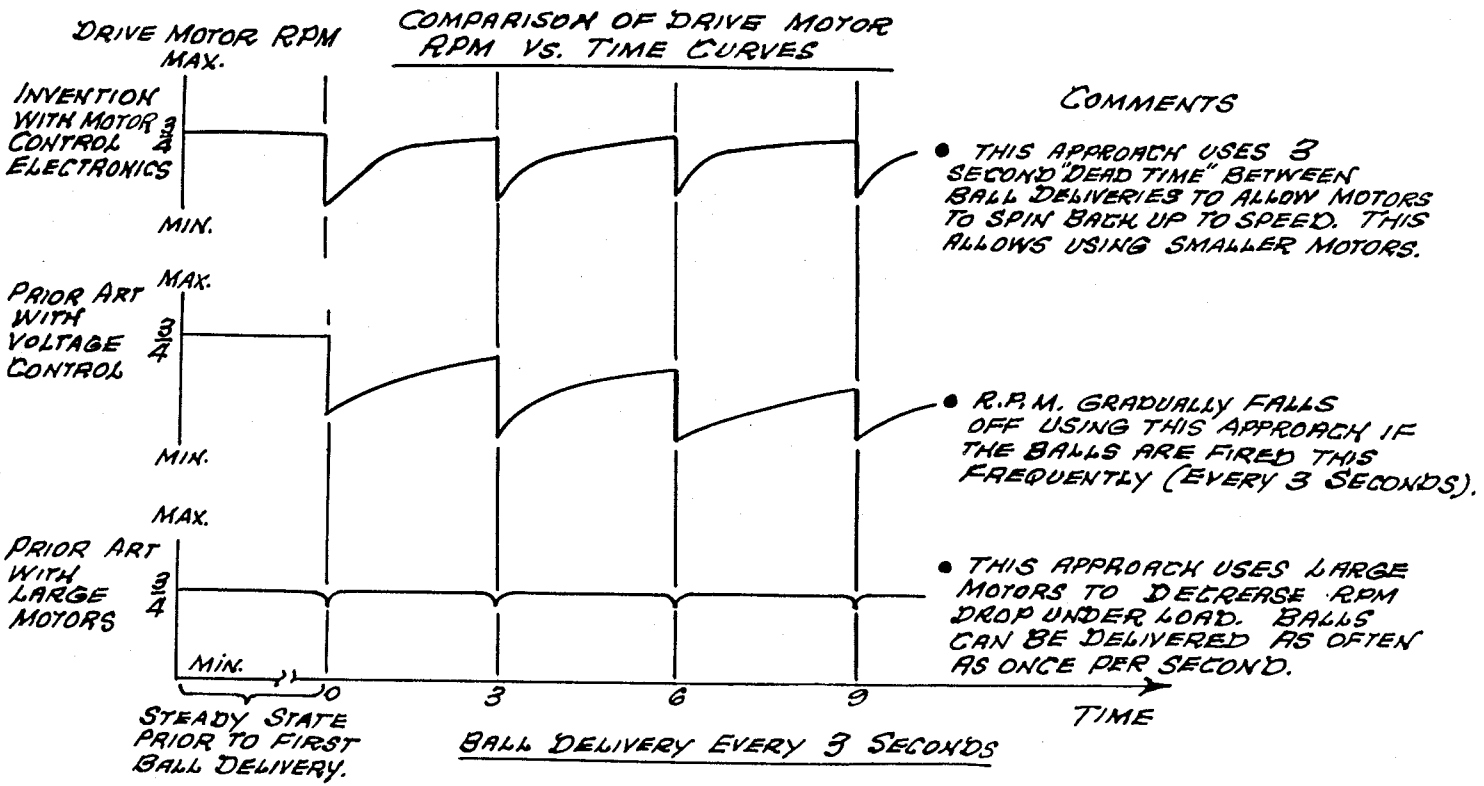
FIG. 10 is a graphical representation comparing drive motor RPM vs. time characteristics of certain prior art ball throwers and contrasting these with the superior characteristics of this invention.

FIG. 10 contrasts the RPM vs. Time characteristics of this invention with two typical types of prior art machines, one of which utilizes voltage control and the other large high torque motors, each using these design expedients to avoid decrease in operating speed in successive ball throwing cycles. Each graph is based on a 3-second ball delivery cycle.

The top graph shows the operating characteristics of this invention which functions in a highly stable and satisfactory manner to full restore the operating speed of motors 35 between 3-second ball throwing cycles.

The prior art design utilizing voltage control is incapable of fully restoring operating speed between 3-second cycles and in consequence, the operating speed gradually fades.

The prior art large motor type depicted in the lowest graph avoids speed drop between cycles and is capable of operating in shorter intervals of time but at the expense of heavy bulky non-handportable equipment consuming very substantial quantities of power.

Figure 8:
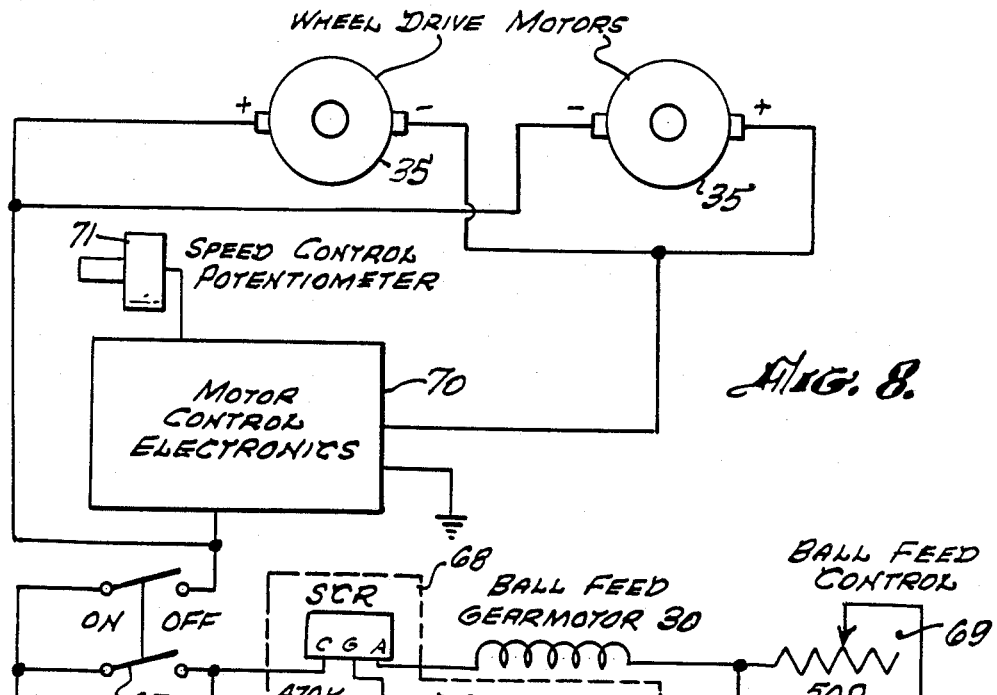
FIG. 8 is a condensed schematic of the electrical circuitry.
Figure 7:
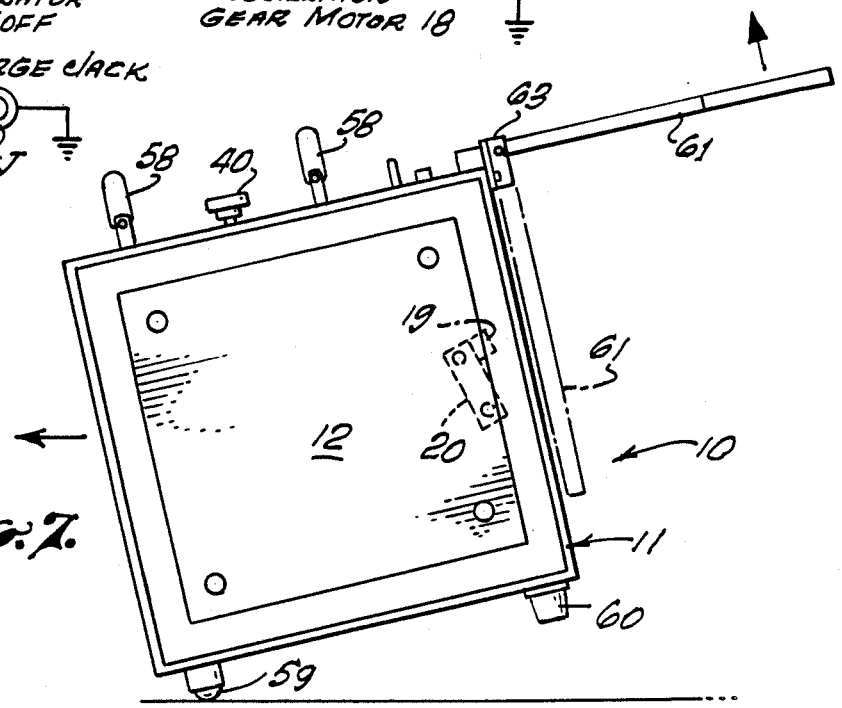
FIG. 7 is a view of the ball thrower as positioned for towing while supported on a pair of rollers mounted along one vertical corner of the housing and showing the towing handle extended in full lines and collapsed in dot and dash lines.

The simplified schematic shown in FIG. 8 shows the sealed 12-volt storage battery 65 supplying power via control switch 66 to the drive motor 18 for oscillating the ball thrower in a horizontal arc. The ball feeding motor 30 is supplied with power through the double throw switch 67 via the time delay circuit 68 and a speed control rheostat 69. The power supply to the ball throwing motors 35 is controlled by the second blade of switch 67 and the solid state circuitry represented at 70 and the associated speed control potentiometer 71, the details of this important circuitry being shown in detail in FIG. 9.

Figure 9:
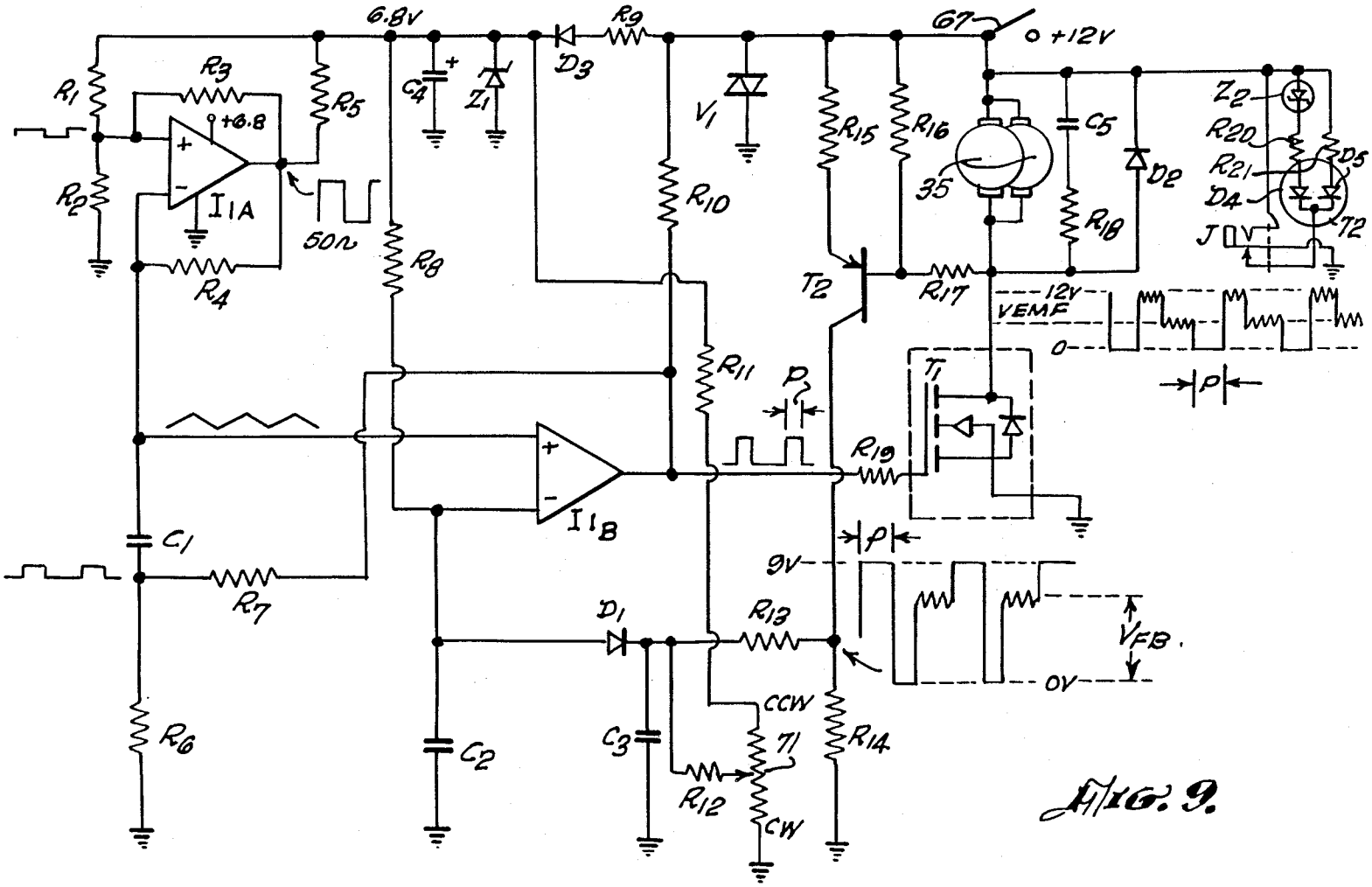
FIG. 9 is a schematic of the control circuitry for the two ball throwing motors.

The solid state control circuitry 70 illustrated in FIG. 9 operates at approximately 98% efficiency, so important to a ball thrower having hand portability and powered by an on-board battery. Moreover, the entire circuitry is very small; weighs only a few ounces; permits ball speed over a range greater than 2 to 1; provides for full motor speed as loads vary; and provides full motor speed up from a standing start in less than 6 seconds as contrasted with the up to 15-second spin-up time if using voltage control. Another important feature is a constant motor drive speed for a given setting of the ball speed control knob as the battery voltage decays during use. This is accomplished as will be explained by a voltage clamping circuit set at a level substantially below normal battery charge level and functioning in concert with motor voltage feedback.

The electronic control circuit for ball throwing motors 35 operates to switch the power on and off in pulses of variable width at a frequency generated by an oscillator to restore quickly the speed lost as a ball is thrown. The width of the power pulse is determined by comparing the back electromotive force generated by the motors with a reference voltage signal to provide for constant speed control as the battery voltage decays during discharge. The reference voltage signal is provided by a circuit clamping the voltage at a stable reference value, such as 6.8 volts. This clamping circuit comprises resistor R9, diode D3, zener diode Z1 and capacitor C4. Diode D3 serves as a disconnect diode to prevent negative transients from discharging filtering capacitor C4. Zener diode Z1 clamps the voltage on the line at a suitable reference voltage such as that mentioned above.

This reference voltage activates an oscillator circuit comprising an integrated circuit comparator I1A and its associated components R1 to R6 and C1, this comparator having a square wave output of a suitable frequency, such as 50 cycles, and an amplitude which varies between 6.8 volts and 0 volts. This output signal alternately charges and discharges capacitor C1 via resistor R4, creating a triangular reference voltage signal which is applied to the positive input of the integrated circuit comparator **I1*b***.

At the instant a ball is thrown, the speed of motors 35 drops as does the back EMF, the latter being represented by the signal VEMF below motors 35 in FIG. 9. This signal appearing at the junction of T1, R17 and motors 35, is applied to the base of transistor T2 which is a common emitter amplifier stage having a gain output determined by the values of resistors R14, R15, R16 and R17. The motor back EMF signal inverted by transistor T2 appears at the junction of R13 and R14 and is represented graphically to the right of that junction. The signal passes through resistor R13 and is offset by a DC voltage determined by resistors R11, R12 and the motor speed control potentiometer 71, the latter serving to vary the DC offset voltage added to the feedback signal.

Diode D1 clips the positive portion of this feedback signal and passes only the pure feedback portion Vfb to the negative input of the integrated circuit comparator **I1*b* which offsets the positive bias supplied through R8. Capacitor C3 filters out the higher frequency components of the feedback signal. Capacitor C2 filters the feedback signal so that the comparator sees an average value of Vfb. As the signal decreases or increases on the comparator I1*b* negative input, the comparison of that signal with the triangular wave form present at the comparator positive input provides an output signal which is proportionally wider or narrower respectively and this output is delivered to the gate of transistor T1 through current limiting resistor R19. Transistor T1 comprises four metal oxide semi-conductor field effect transistors in parallel. When T1 is driven by comparator I1*b* it conducts thereby placing the negative terminals of motors 35 at ground potential. Since the positive terminals of the motors are at positive 12 volts, the full supply voltage of the battery is placed across the motors for the time interval controlled by the output signal of comparator I1*b***. If the oscillator provides a 50 hertz signal, then this full power pulse is applied to the motors 50 times per second.

As now will be apparent, this feedback action provides the speed regulation for these motors. It also provides constant throwing motor speed for a specific setting of the speed control potentiometer 71 even though the battery voltage is falling during battery discharge. This constant motor speed is achieved because the reference voltage signal applied to the positive input of comparator I1*b* is clamped at 6.8 volts. The comparator compensates for decreasing back EMF by widening its output pulse width in an amount to supply constant power to the motors until the battery voltage has fallen so far the comparator remains fully on. The output of comparator I1*b*, which is stabilized by current flowing through resistor R10 when it is not in an output state, not only drives the gate of transistor T1 but also completes a hysteresis loop to ground through resistors R6 and R7. The hysteresis loop prevents oscillation when the comparator is in an output state.

The solid state control circuitry also includes important circuit protection features. For example, when transistor T1 is shut off an inductive spike is produced. This spike is clamped by diode D2 which is in parallel with motors 35. This prevents a large potentially dangerous positive voltage from reaching transistor T1. This voltage spike is shown clamped at the plus 12-volt level in the graph below the motors in FIG. 9.

There is also a rate suppression network consisting of capacitor C5 and resistor R18 connected across the terminals of motors 35. This network reduces radio frequency noise and controls the rise and decay times of the voltage to motors 35 when power is applied and removed. In addition, varistor V1 acts as a transient suppression device to clamp any extraneous inductive pulses which might appear on the positive voltage supply line to less than 22 volts.

Another adjunct comprises a battery charge monitor which includes a jack J having its plug receiving end mounted in the sidewall of the apparatus housing shown in FIG. 1 into which a plug connected to a source of charging power can be inserted. This jack is connected in circuit with dual light emitting diodes 72 mounted on the control panel of the apparatus housing (FIG. 1), a zener diode Z2, and resistors R20, R21.

The battery monitoring circuit is only in operation when a plug is present in Jack J. The light emitting diode D4 in circuit with resistor R20 is green whereas the other diode D5 is red, both being enclosed in the same physical package so that their light output is combined. When the battery voltage is below 12 volts, the red diode glows whereas the other diode does not begin to glow green until the battery voltage approaches 13 volts. The green diode does not glow until the battery voltage exceeds the zener voltage of zener diode Z2. Resistors R20 and R21 provide current limiting for diodes D4 and D5 respectively.

When the battery is discharged and the charging power plug is inserted into jack J only the red diode will glow. As the battery charges, the green diode will begin to glow and as the charge increases it will glow more brightly than the red diode, the green color dominating as the full battery charge is reached. The increasing green light as the battery charges will cause the light output of the two diodes to change from red, to orange, to yellow, and finally to green as the battery becomes fully charged, thereby providing a changing visual indication of the state of battery charge.

OPERATION

Ball throwing apparatus 10 is placed in operation by transporting and/or hand carrying it to a playing area and placing the feet 60 on stationary base 12 on a supporting surface. The hopper sidewall panels 24 are then placed in use by releasing them from a catch (not shown) holding them collapsed and opening them to their extended position and filling the hopper with a supply of balls. Shelf 36 supporting the motors 35 and the ball throwing wheels 49 is adjusted to eject the balls 31 grasped in between their spacing from any point along the immovable length of chute 33 for any pivoted position of shelf and wheels in a desired vertical trajectory. The clamping knob 40 adjusts the tilt position of the shelf and then clamps it firmly in this position by tightening knob 40. The oscillator motor, if desired, is then turned on by closing switch 66 to drive motor 18 to oscillate the apparatus housing 11 to-and-fro horizontally about pivot bolt 13. The ball feed control potentiometer 69 is adjusted to index balls for gravity flow down chute 33 and into the ball-throwing-wheels position at desired intervals after the ball feed motor 30 has been activated. Switch 67 controlling current flow to this motor and to the motor control electronics complex 70 is typically made or thrown after all other adjustments have been made. However, the time delay component 68 delays energization of the ball feed motor 30 for an appropriate length of time, such as 8 seconds, after energization of the solid state circuitry 70 to permit motors 35 to reach full operating speed. This gives time for the player to reach his playing position and prevents the premature ejection of balls before the motors are up to their proper operating speed.

The solid state circuitry then functions as outlined above by generating a steady state oscillating signal converted to a triangular configuration and supplied to the positive terminal of comparator I1*b*. As each ball is thrown there is a precipitous and almost instantaneous decrease in motor speed accompanied by a decrease in their back EMF. This signal is converted into pulses and supplied to the base of the amplifier transistor T2 where it is inverted in amplified form at the junction of R13, R14. This back EMF signal proportional to motor speed is delivered to the negative input of comparator I1*b* to provide output signal pulses in step with the frequency of the oscillator circuit and of variable width. This variable signal is utilized to turn on the field effect transistor T1 to supply full power to motors 35 for variable pulse periods and at the rate of the oscillator output signal. In this manner the resumption of full speed of motors 35 is restored in a most efficient and expedited manner. If the operator wishes to vary the speed of motors 35 he adjusts the potentiometer 71 to vary the DC offset voltage added to the feedback signal enroute to comparator I1*b*.

Suitable values and identification of the solid state components found to provide excellent results in the high efficiency control circuit shown in FIG. 9 are as follows:

| Component | Description |
|---|---|
| R1 | 24K ohm |
| R2 | 33K ohm |
| R3 | 470K ohm |
| R4 | 510K ohm |
| R5 | 10K ohm |
| R6 | 270 ohm |

-continued

| Component | Description |
|---|---|
| R7 | 100K ohm |
| R8 | 1 M ohm |
| R9 | 330 ohm |
| R10 | 1.8K ohm |
| R11 | 390 ohm |
| R12 | 39K ohm |
| R13 | 100K ohm |
| R14 | 8.2K ohm |
| R15 | 1K ohm |
| R16 | 1.2K ohm |
| R17 | 6.8K ohm |
| R18 | 160K ohm |
| R19 | 82 ohm |
| R20 | 1K ohm |
| R21 | 22K ohm |
| P1 | 5K linear taper |
| C1, C2 | .33 microfarads |
| C3 | .022 microfarads |
| C4 | 470 microfarads |
| C5 | .47 microfarads |
| D1, D3 | IN4148 |
| D2 | IN 5400 |
| D4, D5 | Dual diode, red/green, RS276-025 |
| Z1 | 6.8 V, IN754 |
| Z2 | 12 V, IN4742 |
| V1 | Varistor, S14K14 |
| T1 | MOSFET, BUZ 71 |
| T2 | 2N3906 |
| 1C1A, 1C1B | Integrated Circuit, LM393N |

The resistors are rated at one-half watt and the capacitors are rated at 50 volts.

While the particular hand-carried selectively operable by on-board battery or an AC to DC power converter ball throwing apparatus herein shown and disclosed in detail is fully capable of attaining the objects and providing the advantages hereinbefore stated, it is to be understood that it is merely illustrative of the presently preferred embodiment of the invention or design herein shown and the scope and spirit of the invention is not limited or restricted other than as defined in the appended claims.

I CLAIM:

1. A portable, self-contained power driven, compact, light-weight ball throwing apparatus comprising a housing for said apparatus, a pair of spaced motor-driven counter-rotating ball throwing wheels for ejecting balls from said apparatus, shelf means, said wheels mounted and supported on said shelf means, a ball indexing feeder means for accomodating one ball at a time for delivery to said wheels, means for delivering by gravity each ball to said wheels, said delivering means comprising an inclined chute fixedly mounted in said housing and having an immovable length between upper and lower ends for said chute, the upper of said ends operatively connected to said ball feeding and indexing means, said shelf means pivotally mounted in front of the immovable length and independently of said chute about a horizontal axis which is positioned forwardly of a generally upright plane containing the axes of said wheels, said wheels pivotable with said shelf means, such forward position of the horizontal axis of said shelf means producing a relationship between the pivoting of said shelf means and said chute such that a ball is grasped by said wheels from any point on the length only of said chute for any pivoted position for said shelf means and wheels.

2. The apparatus as defined in claim 1 characterized by manually adjustable means for varying the operating speed of said motor-driven counter-rotating wheels.

3. The apparatus as defined in claim 1 characterized by said apparatus being adapted for hand carrying and sized for convenient transport in the trunk of a conventional passenger motor vehicle.

4. The ball throwing apparatus as defined in claim 1 characterized by means for manually adjusting the pivotal position of said counter-rotating wheels and for retaining the same selectively in different pivoted positions.

5. The apparatus as defined in claim 1 characterized by sound and vibration absorbing means mounted on said shelf means operatively connected to said housing.

6. The apparatus as defined in claim 5 characterized by said sound vibration absorbing means including elastomeric spring-biased friction means between said housing and adjacent ends of said shelf means.

7. The apparatus as defined in claim 1 characterized by said housing including an underlying base pivotally connected thereto about an upright axis, and DC motor-driven means operable to pivot said housing to-and-fro in a predetermined horizontal arc about said upright axis to vary the lateral trajectory of successive balls.

8. The apparatus as defined in claim 1 characterized by provision of control circuit means for the motors of said motor-driven wheels and which includes means for generating an oscillating signal for controlling the flow of power to said last mentioned motors in pulses in synchronism with said oscillating signal.

9. The apparatus as defined in claim 1 characterized in that said housing is provided with spaced-apart wheel means along one exterior edge thereof; and a propelling handle pivotably connected to the diagonally opposed exterior edge of said housing; said handle being foldable against the said housing when not in use and being constructed and arranged to pivot to a stable extended position for use in tilting said housing to an inclined towable travel position supported on said wheel means.

10. The apparatus of claim 1 characterized by a collapsible ball hopper mounted atop said housing and compactible thereagainst when not in use.

11. The apparatus of claim 1 including a low voltage on-board storage battery for powering said apparatus, and an electronic circuitry operatively connecting said battery to motors for said wheels and to said ball indexing feeder means.

12. The apparatus as defined in claim 11 characterized in that said electronic circuitry includes solid state circuit control means operable to expedite the recovery of speed of said counter-rotating wheels to full speed following each ball throwing cycle.

13. The apparatus as defined in claim 12 characterized by said solid-state circuit control means inter-connecting said storage battery and said ball feeding means to provide sufficient time between the delivery of successive balls to said counter-rotating wheels for said wheels to recover to substantially the same normal operating speed before the start of the next ball throwing cycle whereby successive balls are launched at substantially the same velocity.

14. The apparatus as defined in claim 12 characterized by said control circuit means including means for varying the normal operating speed of said motors for said motor-driven wheels.

15. The apparatus as defined in claim 12 characterized by said solid state circuit control means including charge monitoring means mounted on said housing operable to provide a visual indication of the state of charge of said storage battery as said battery is being charged from an external power source, said charge monitoring means including visual indicators and means in said circuit with said indicators by which one of said indicators provides a visual indication when the battery voltage is at a relatively low charge value and the other provides a visual signal when the battery is at a relatively high charge value.

16. The apparatus as defined in claim 15 characterized by one of said visual indicators being operable to provide a visual indication from power supplied solely from said storage battery that said battery is in need of recharging.

17. The apparatus as defined in claim 15 characterized by said charge monitoring means for providing a visual indication of the charge condition of said storage battery comprising two light emitting diodes, each of said diodes of different color when energized.

18. The apparatus as defined in claim 17 characterized by said light emitting diodes being in closely spaced partially shrouded condition and operable to display a characteristic distinctive color as well as a distinctive combined color as said battery undergoes a generally complete charging cycle thereby to indicate the state of charge at different times.

19. The apparatus as defined in claim 12 characterized in that said solid state circuit control means includes time delay means for activating said ball feeding means by a time interval adequate for the user to reach a playing position before ejection of the first ball from said apparatus, said time interval beginning simultaneously with power to the apparatus.

20. The apparatus as defined in claim 11 characterized by power-driven means powered by said on-board battery for oscillating said housing through a horizontal arc to vary the lateral trajectory of balls thrown from between said counter-rotating wheels.

21. The apparatus as defined in claim 11 characterized by the provision of means for connecting a source of battery-charging power to said on-board storage battery and including indicator means operable to provide a visual indication of the charge condition of said storage battery.

* * * * *